US011109643B2

(12) United States Patent
Foxen

(10) Patent No.: US 11,109,643 B2
(45) **Date of Patent: *Sep. 7, 2021**

(54) ARTICLE OF FOOTWEAR WITH DYNAMIC EDGE CAVITY MIDSOLE

(71) Applicant: NIKE, Inc., Beaverton, OR (US)

(72) Inventor: Thomas Foxen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 179 days.

This patent is subject to a terminal disclaimer.

(21) Appl. No.: 16/153,900

(22) Filed: Oct. 8, 2018

(65) Prior Publication Data

US 2019/0037964 A1 Feb. 7, 2019

Related U.S. Application Data

(63) Continuation of application No. 14/811,623, filed on Jul. 28, 2015, now Pat. No. 10,111,492.

(60) Provisional application No. 62/042,096, filed on Aug. 26, 2014.

(51) Int. Cl.
*A43B 13/18* (2006.01)
*A43B 13/12* (2006.01)

(52) U.S. Cl.
CPC ..... *A43B 13/181* (2013.01); *A43B 13/125* (2013.01); *A43B 13/183* (2013.01); *A43B 13/187* (2013.01)

(58) Field of Classification Search
None
See application file for complete search history.

(56) References Cited

U.S. PATENT DOCUMENTS

| | | | |
|---|---|---|---|
| 4,241,523 | A | 12/1980 | Daswick |
| 4,566,206 | A | 1/1986 | Weber |
| 4,854,057 | A | 8/1989 | Misevich et al. |
| 5,279,051 | A | 1/1994 | Whatley |
| 5,381,608 | A | 1/1995 | Claveria |
| 5,881,478 | A | 3/1999 | McMahon et al. |
| 6,647,645 | B2 | 11/2003 | Kita |
| 6,925,732 | B1 | 8/2005 | Clarke et al. |

(Continued)

FOREIGN PATENT DOCUMENTS

| | | | |
|---|---|---|---|
| CN | 102368922 | A | 3/2012 |
| CN | 102438478 | A | 5/2012 |

(Continued)

OTHER PUBLICATIONS

European Patent Office, Office Action for EP Application No. 15747726.6, dated Apr. 10, 2018.

(Continued)

*Primary Examiner* — Jila M Mohandesi
(74) *Attorney, Agent, or Firm* — Honigman LLP; Matthew H. Szalach; Jonathan O'Brien

(57) ABSTRACT

An article of footwear that offers different levels of cushioning and support depending on the direction of force applied to the midsole. An outer edge of the midsole includes an inwardly-extending elongate groove with a V-shaped cross-sectional configuration. An elongate insert having a V-shaped cross-sectional configuration is secured to the elongate groove. The insert forms a spring that dynamically alters the character of the support provided by the footwear to a foot of a wearer during "banking" or side-to-side movement.

20 Claims, 16 Drawing Sheets

(56) References Cited

U.S. PATENT DOCUMENTS

| | | | | |
|---|---|---|---|---|
| 7,100,308 | B2 | 9/2006 | Aveni | |
| 7,159,339 | B2 | 1/2007 | Mathieu et al. | |
| 8,074,377 | B2 * | 12/2011 | Nishiwaki | A43B 13/141 36/25 R |
| 8,082,684 | B2 | 12/2011 | Munns | |
| 8,151,485 | B2 * | 4/2012 | Hurd | A43B 13/183 36/27 |
| 8,387,279 | B2 | 3/2013 | Pauk et al. | |
| 8,635,785 | B2 | 1/2014 | Seo et al. | |
| 8,732,986 | B2 * | 5/2014 | Miner | A43B 13/141 36/29 |
| 9,468,256 | B2 * | 10/2016 | Miner | A43B 13/02 |
| 9,961,965 | B2 * | 5/2018 | Miner | A43B 13/16 |
| 2003/0061731 | A1 | 4/2003 | Turner et al. | |
| 2005/0102859 | A1 | 5/2005 | Yen | |
| 2006/0117604 | A1 * | 6/2006 | Fusco | A43B 1/0027 36/25 R |
| 2007/0028484 | A1 | 2/2007 | Akhidime | |
| 2007/0039204 | A1 | 2/2007 | Wyszynski et al. | |
| 2007/0240331 | A1 | 10/2007 | Borel et al. | |
| 2008/0184595 | A1 * | 8/2008 | Schindler | A43B 13/20 36/29 |
| 2008/0244926 | A1 * | 10/2008 | Yu | A43B 7/1415 36/28 |
| 2009/0013556 | A1 * | 1/2009 | Nishiwaki | A43B 13/183 36/28 |
| 2009/0178303 | A1 | 7/2009 | Hurd et al. | |
| 2011/0138652 | A1 | 6/2011 | Lucas et al. | |
| 2011/0185590 | A1 | 8/2011 | Nishiwaki et al. | |
| 2012/0079747 | A1 | 4/2012 | Seo et al. | |
| 2014/0310982 | A1 | 10/2014 | Delattre et al. | |
| 2015/0157088 | A1 | 6/2015 | Seo et al. | |
| 2016/0058122 | A1 | 3/2016 | Foxen | |

FOREIGN PATENT DOCUMENTS

| | | | |
|---|---|---|---|
| CN | 202525257 | U | 11/2012 |
| EP | 1048233 | A2 | 11/2000 |
| EP | 2332432 | A1 | 6/2011 |
| FR | 2982745 | A1 | 5/2013 |
| JP | H0385103 | A | 4/1991 |
| WO | WO-2013/169063 | A1 | 11/2013 |
| WO | WO-2015/059744 | A1 | 4/2015 |

OTHER PUBLICATIONS

State Intellectual Property Office (PRC), Office Action for CN Application No. 201580045745.2, dated Jul. 27, 2018.

International Search Report and Written Opinion dated Oct. 15, 2015 for PCT Application No. PCT/US2015/042672.

United States Patent and Trademark Office, Office Action for U.S. Appl. No. 14/811,623, dated Jun. 7, 2017.

United States Patent and Trademark Office, Office Action for U.S. Appl. No. 14/811,623, dated Jan. 17, 2018.

United States Patent and Trademark Office, Office Action for U.S. Appl. No. 14/811,623, dated Jan. 10, 2017.

European Patent Office, Extended European Search Report for EP Application No. 19176595.7, dated Nov. 29, 2019.

China National Intellectual Property Administration, Office Action for CN Application No. 201580045745.2, dated Mar. 25, 2019.

* cited by examiner

ARTICLE OF FOOTWEAR WITH DYNAMIC EDGE CAVITY MIDSOLE

CROSS-REFERENCE TO RELATED APPLICATION

This application is a Continuation of U.S. Non-provisional patent application Ser. No. 14/811,623, filed Jul. 28, 2015, which claims priority under 35 U.S.C. § 119(e) to U.S. Provisional Patent Application Ser. No. 62/042,096, which was filed in the U.S. Patent and Trademark Office on Aug. 26, 2014 and entitled "Article Of Footwear With Dynamic Edge Cavity Midsole", the disclosures of which are incorporated herein by reference in their entireties.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace may be utilized to modify the dimensions of the void and secure the foot within the void.

The sole structure is located adjacent to a lower portion of the upper and is generally positioned between the foot and the ground. In many articles of footwear, including athletic footwear, the sole structure generally incorporates an insole, a midsole, and an outsole. The insole, which may be located within the void and adjacent to a lower surface of the void, is a thin compressible member that enhances footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

Generally, the midsole is the primary source of cushioning for the article of footwear, and it is primarily formed from a foamed polymer material, such as polyurethane or ethyl-vinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and the upper, located between the midsole and the outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Midsoles tend to optimize support and cushioning comfort for a wearer when walking or running. The forces acting on the midsole during these activities tend to be directed vertically and in a forward and aft direction relative to the article of footwear. Midsoles are designed to return predictable and consistent cushioning comfort and support when encountering these forces.

Side-to-side or "banking" movement, particularly among athletes like football, basketball and tennis players, is also common. Usually, it is desirable for an athlete to quickly change his or her side-to-side direction when banking. Accordingly, many athletes prefer more stable and supportive footwear with less cushioning during these banking maneuvers. However, footwear, and in particular midsoles, tend to offer the same or a similar level of cushioning and support throughout the entire range of use of the footwear whether when walking, running or banking.

SUMMARY

An outer edge of a midsole may be modified to incorporate an inwardly-extending elongate groove with a V-shaped cross-section, and an elongate insert with a V-shaped cross-section may be secured to the groove. The insert may form an elongate spring on a medial portion, heel portion, and lateral portion of the midsole.

The support provided by the elongate insert may be particularly advantageous during "banking" (e.g., leaning to one side or pushing off to the side from the medial or lateral side of the foot). During a banking maneuver, the amount of cushion offered in the direction of an applied banking force may be reduced while the support provided to a wearer's foot may increase. This may improve the wearer's "feel" of the ground and response time during banking.

In one aspect, the invention provides an article of footwear having an upper and a sole structure secured to the upper. The sole structure comprises a midsole, an elongate spring, and an outsole. The midsole has an upper surface, an opposite lower surface, and an outer edge extending between the upper surface and the lower surface. The outer edge has a forefoot portion, a heel portion, a lateral portion, and a medial portion. The midsole has an inwardly-extending elongate groove continuously disposed along the medial portion, the heel portion, and the lateral portion. The elongate spring is secured to the outer edge of the midsole along an entire length of the elongate groove. The outsole is secured to the lower surface of the midsole, and forms a ground-engaging portion of the footwear.

In another aspect, the invention provides an article of footwear having an upper and a sole structure secured to the upper. The sole structure comprises a midsole, an insert, and an outsole. The midsole is formed from a foamed polymer material and has an upper portion, an opposite lower portion, an inwardly-extending elongate groove, and a central base portion. The upper portion and lower portion are spaced from each other along the elongate groove, and the upper portion and lower portion are joined to each other at the central base portion. The insert is formed from a non-foamed polymer material and has an inner surface and an opposite outer surface. The elongate groove covers the inner surface. The outsole is formed from a rubber material and is secured to the lower portion of the midsole.

In another aspect, the invention provides an article of footwear having an upper and a sole structure secured to the upper. The sole structure has an edge insert that encircles the sole structure from a medial side of the sole structure to a lateral side of the sole structure. The edge insert has a spring characteristic that resists vertical forces equally on the medial side and the lateral side.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose various configurations of sole structures. Concepts associated with the sole structure may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the sole structure may also be utilized with footwear styles that are generally considered to be non-athletic, including dress shoes, loafers, and sandals.

General Footwear Structure

Figure 1:
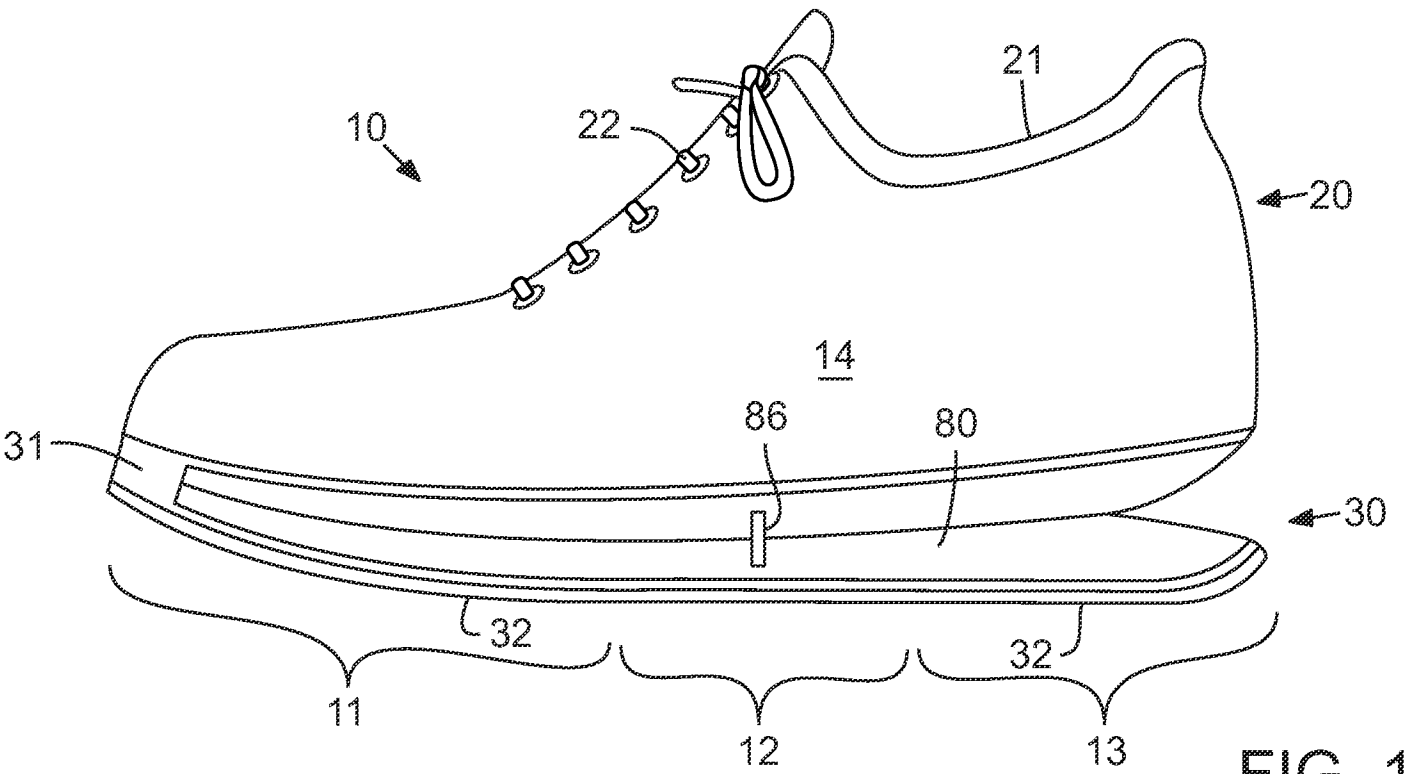
FIG. 1 is a lateral side elevational view of an article of footwear having a midsole and an elongate insert.
Figure 2:
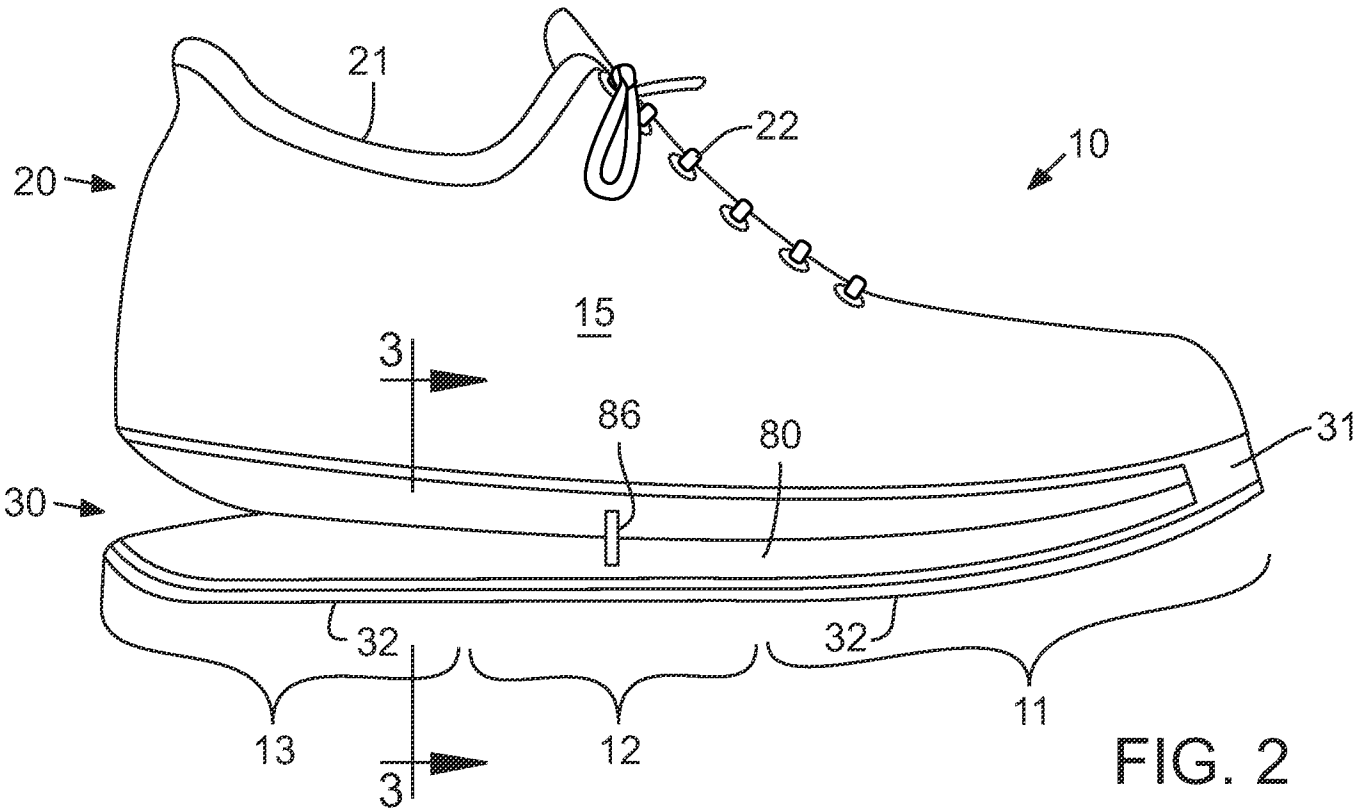
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIG. 1. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 generally includes portions of footwear 10 corresponding with rear portions of the foot, including the calcaneus bone. Footwear 10 also includes a lateral side 14 and a medial side 15. Lateral side 14 and medial side 15 extend through each of regions 11-13 and correspond with opposite sides of footwear 10.

Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be discussed with respect to the individual elements thereof, such as upper 20 and sole structure 30, and to the foot itself.

Upper 20 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22.

Given that various aspects of the present application primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation.

The primary elements of sole structure 30 are a midsole 31 and an outsole 32. Midsole 31 may include a fluid-filled chamber. In addition, midsole 31 may incorporate one or more additional footwear elements that enhance the comfort, performance, or ground reaction force attenuation properties of footwear 10, including a polymer foam material, such as polyurethane or ethylvinylacetate, plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground.

Sole structure 30 may also incorporate an insole or sockliner that is located within the void in upper 20 and adjacent (i.e., located nearby or close to, although not necessarily in contact with) a plantar surface or lower surface of the foot to enhance the comfort of footwear 10. A footplate may additionally be disposed between the insole and midsole 31 to further enhance support.

Midsole Configuration

Sole structure 30 is depicted in FIGS. 1-6 as including midsole 31 and an elongate midsole insert 80. Midsole 31 has an upper surface, an opposite lower surface, and an outer edge 50 extending between the upper surface to the lower surface. Outer edge 50 accordingly encircles midsole 31 and corresponds with the overall footprint of the article of footwear 10. Outer edge 50 includes a forefoot portion 52 located in forefoot region 11, a medial portion 54 located on medial side 15, a lateral portion 56 located on lateral side 14, and a heel portion 58 located in heel region 13.

Outer edge 50 has a continuous recessed elongate groove 60 that extends inwardly and is continuously disposed along medial portion 54, heel portion 58, and lateral portion 56. Elongate groove 60 partitions midsole 31 and defines an upper portion 62, a lower portion 64, and a central base portion 68. Upper portion 62 and lower portion 64 are accordingly spaced from each other along elongate groove 60, and are joined to each other at central base portion 68. Upper portion 62 may be further partitioned into a cantilevered upper medial portion 70, a cantilevered upper lateral portion 72, a lower medial portion 75, and a lower lateral portion 77. Upper portions 70 and 72 extend upward and away from central base portion 68, while lower portions 75 and 77 extend downward and away from central base portion 68. Portions 70, 72, 75, and 77 are depicted as extending substantially the same distance from central base portion 68. In other configurations, however, portions 70, 72, 75 and 77 may extend different distances from central base portion 68.

Figure 3:
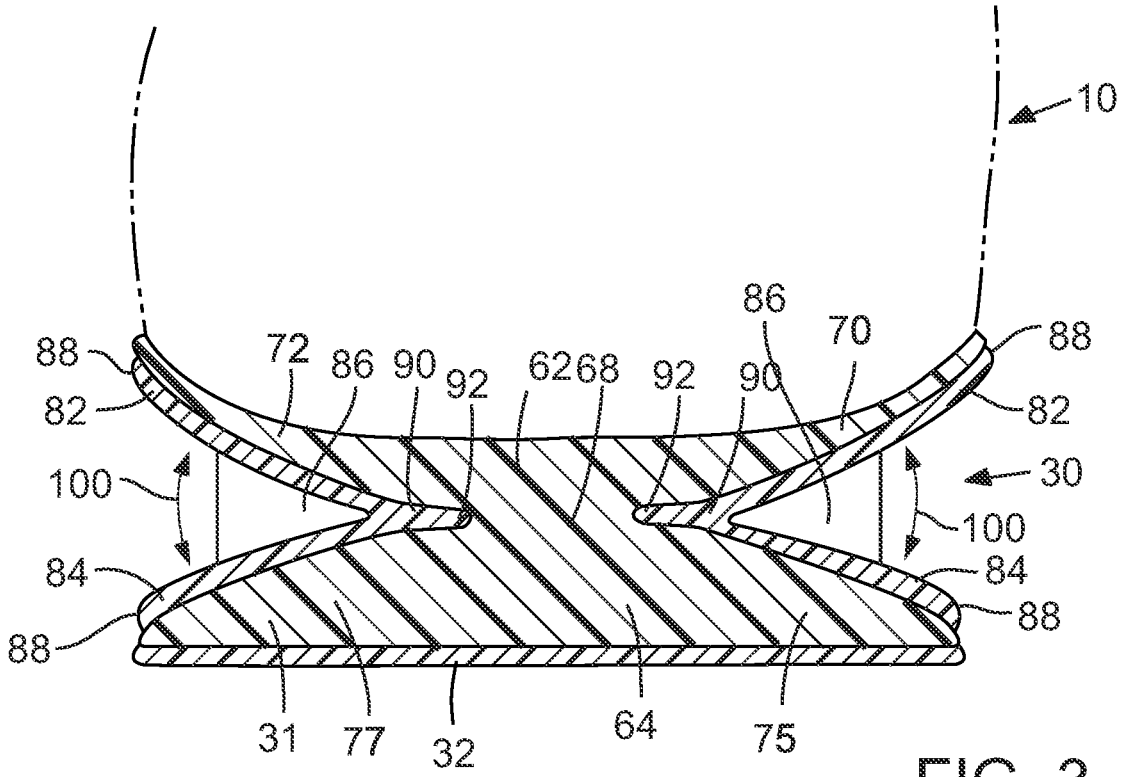
FIG. 3 is a cross-sectional view of the article of footwear, as defined by section line 3-3 in FIG. 2.
Figure 4:
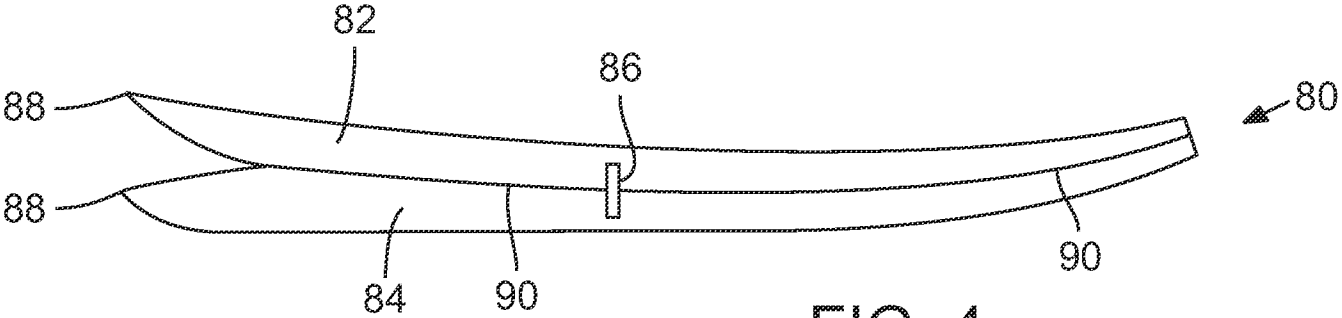
FIG. 4 is a side elevational view of the elongate insert.
Figure 5:
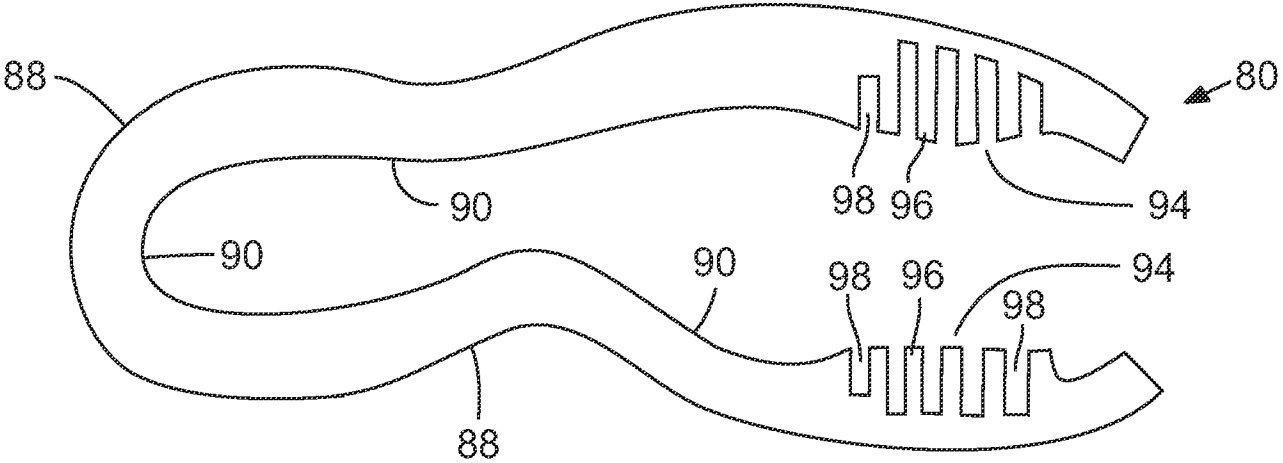
FIG. 5 is a top plan view of the elongate insert.
Figure 6:
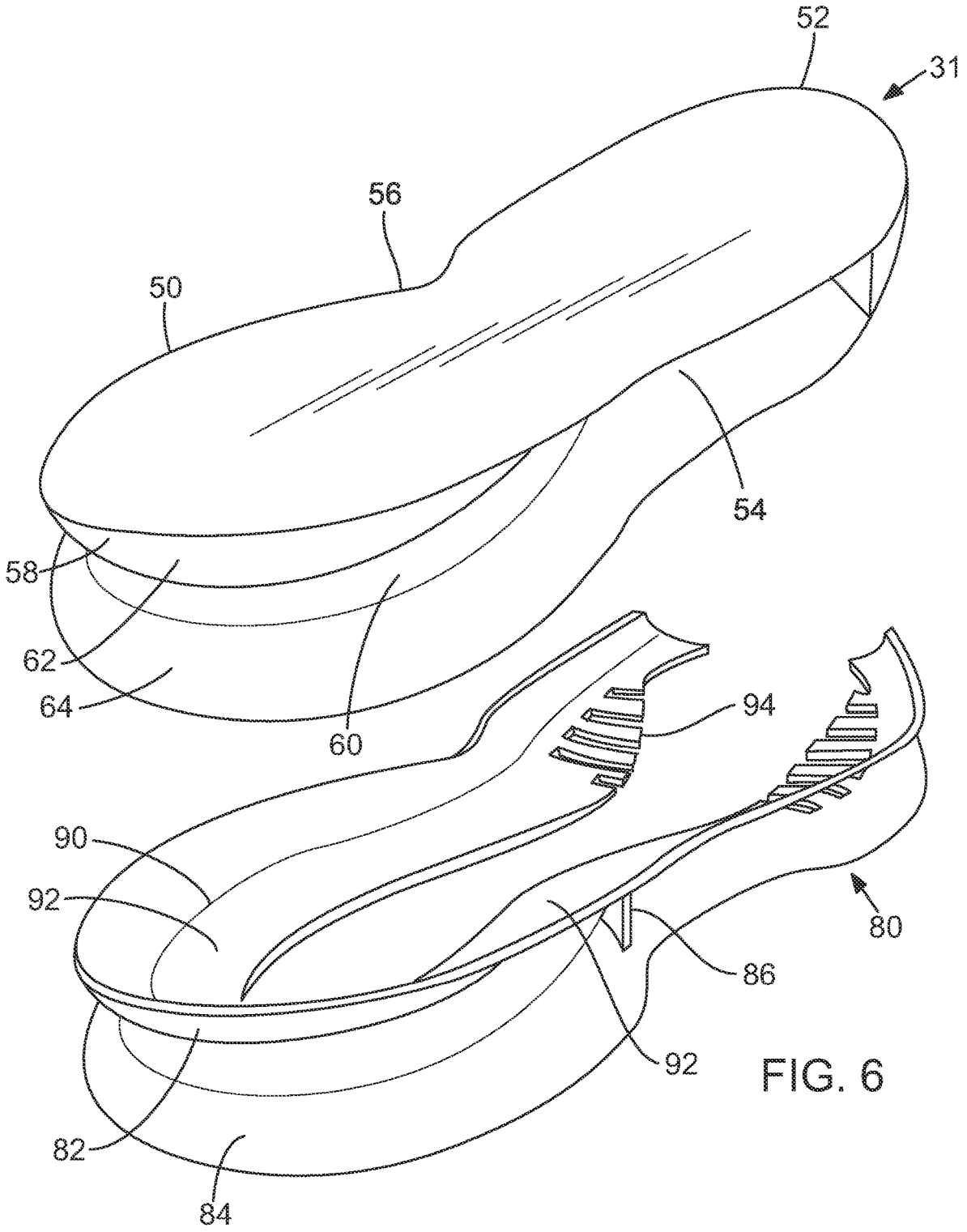
FIG. 6 is a perspective view of the midsole and the elongate insert.

With reference to FIG. 3, elongate groove 60 may have a substantially V-shape in cross-section. The same general cross-sectional shape may extend along medial portion 54, around heel portion 58, and into lateral portion 56. Elongate groove 60 may also extend inward far enough from the overall footprint of footwear 10 to impart to midsole 31 a substantially X-shape in cross section.

Elongate insert 80 is a continuous structure that conforms to elongate groove 60 and extends around medial portion 54, heel portion 58, and lateral portion 56. An inner surface of insert 80 is secured to outer edge 50 within elongate groove 60 using conventional methods such as heat-bonding, adhesives, or the like. Although insert 80 is depicted as being secured to both upper portion 62 and lower portion 64, in some configurations insert 80 may be secured to only one of portions 62 and 64, or may contact only one of portions 62 and 64.

Insert 80 is depicted as having an upper flange 82 and a lower flange 84. Flanges 82 and 84 have outer edges 88 and are joined together at a joined region 90. A horizontal flange 92 in joined region 90 extends inward into midsole 31 for improved rigidity and durability. Outer edges 88 of upper flange 82 extend toward peripheral edges of upper portions 70 and 72 of midsole 31, while outer edges of lower flange 84 extend toward peripheral edges of lower portions 75 and 77 of midsole 31. Flanges 82 and 84 may be sized to be operably received within continuous groove 60.

Insert 80 also includes a pair of stability fins 86 extending between flanges 82 and 84, one positioned on medial side 15 and one positioned on lateral side 14. Stability fins 86 are compressible and provide stability to footwear 10 when placed under banking forces. Stability fins 86 may also be elastically stretchable in addition to being compressible. Accordingly, when placed under banking forces, a stability fin 86 on one side of insert 80 (e.g. lateral side 14) may compress, while a stability fin 86 on an opposite side of insert 80 (e.g. medial side 15) may elastically stretch. Although depicted as being in a single position of midfoot region 12 on each of medial side 15 and lateral side 14, any number of stability fins 86 may be positioned anywhere along insert 80. Stability fins 86 may also be either concentrated in certain locations along insert 80 or distributed throughout insert 80.

In addition, in forefoot region 11, horizontal flange 92 includes comb-like regions 94, in which inward extensions 96 are separated by gaps 98. Comb-like regions 94 may advantageously permit insert 80 to be better secured to midsole 31 in forefoot region 11, while imparting an increased degree of flexibility to horizontal flange 92 in that region.

Flanges 82 and 84 have a substantially V-shape in cross-section, and this same general cross-sectional shape extends along an entire length of elongate groove 60. Flanges 82 and 84 are depicted as extending substantially the same distance from joined region 90, on both medial side 15 and lateral side 14 of footwear 10. However, flanges 82 and 84 may extend different distances from joined region 90 in various other configurations.

Similarly, stability fins 86 may extend to a variety of different distances from joined region 90. For example, in some configurations, stability fins 86 may extend to outer edges 88 of upper flange 82 and lower flange 84. In other configurations, stability fins 86 may be formed to be closer to outer edge 88 on upper flange 82 than on lower flange 84. In yet other configurations, stability fins 86 may be formed to be closer to outer edge 88 on lower flange 84 than on upper flange 82.

Insert 80 and various portions thereof (e.g. upper flange 82, lower flange 84, and stability fins 86) may have thicknesses in a range of between 0.5 mm and 5.0 mm. For example, upper flange 82, lower flange 84, and stability fins 86 may all have a thickness of 2.0 mm. Alternatively, upper flange 82 and lower flange 84 may have a first thickness (such as 2.0 mm), and stability fins 86 may have a different, second thickness between 0.5 mm and 5.0 mm. Moreover, insert 80 and the various portions of insert 80 may have different thicknesses in different regions, such as different thicknesses in joined region 90 or outer regions 88 than in other regions of insert 80.

Midsole 31 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. Midsole 31 and elongate groove 60 may be formed with conventional molding technologies, or elongate groove 60 may be cut away from a molded midsole 31 using techniques applied following a molding process.

Insert 80 may be formed of a stronger, stiffer, or otherwise more rigid material than the material of midsole 31. For example, elongate insert 80 may be formed from a non-foamed polymer material such as a thermoplastic polyurethane (TPU). In such embodiments, a sheet of TPU may be thermoformed to have V-shaped cross-section configuration corresponding to elongate groove 60, and may thereafter be secured to outer edge 50, or may be co-molded with a polymer foam material to form midsole 31 with elongate groove 60. Other materials that may also be used for elongate insert 80 include: an injection-molding-grade thermoplastic or thermoset polymer material; a composite material, such as a fiber-reinforced polymer material, or carbon fiber material; an engineered textile with a fused adhesive skin; or a multi-material laminate structure.

Stability fins 86 may be formed of the same material or materials used to form insert 80. For example, stability fins 86 may be unitarily formed as part of insert 80 (such as by co-molding). Alternatively, stability fins 86 may be formed separately from other portions of insert 80 and may be subsequently joined to insert 80. Thus, in some configurations, stability fins 86 may be adhesively secured to insert 80, or may be mechanically secured to insert 80.

The foamed polymer material of midsole 31 may have a first modulus of elasticity and the non-foamed polymer material of insert 80 may have a second modulus of elasticity, the first modulus of elasticity being less than the second modulus of elasticity. Insert 80 may accordingly have a greater stiffness or rigidity than midsole 31.

The substantially V-shaped cross-sectional configuration of flanges 82 and 84 allow insert 80 to form an elongate spring 100 within groove 60. As shown in FIGS. 1-6, spring 100 is in a neutral, steady-state position.

Figure 7:
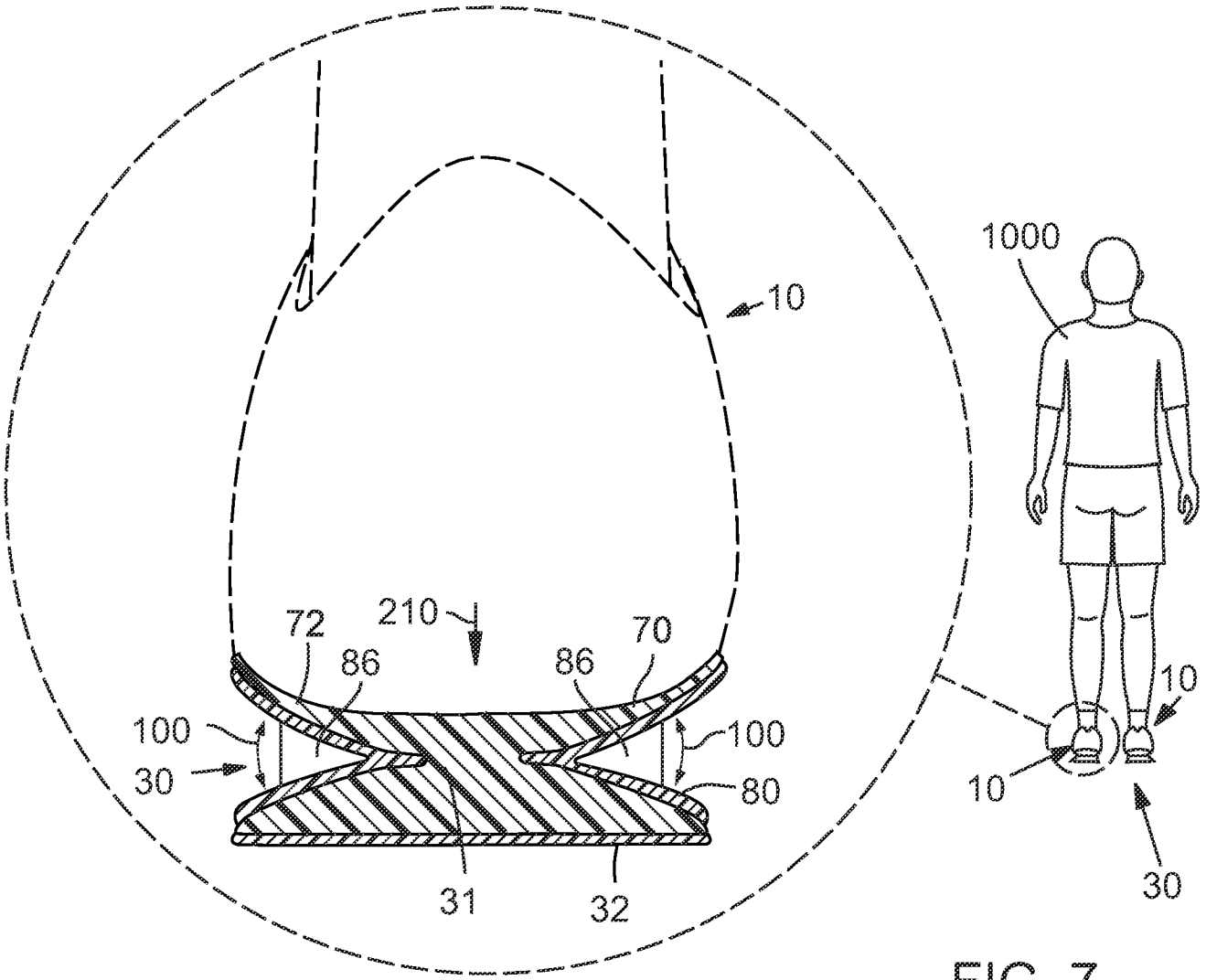
FIG. 7 is a cross-sectional view of the article of footwear of FIGS. 1-6 showing possible application of a vertical force.
Figure 8:
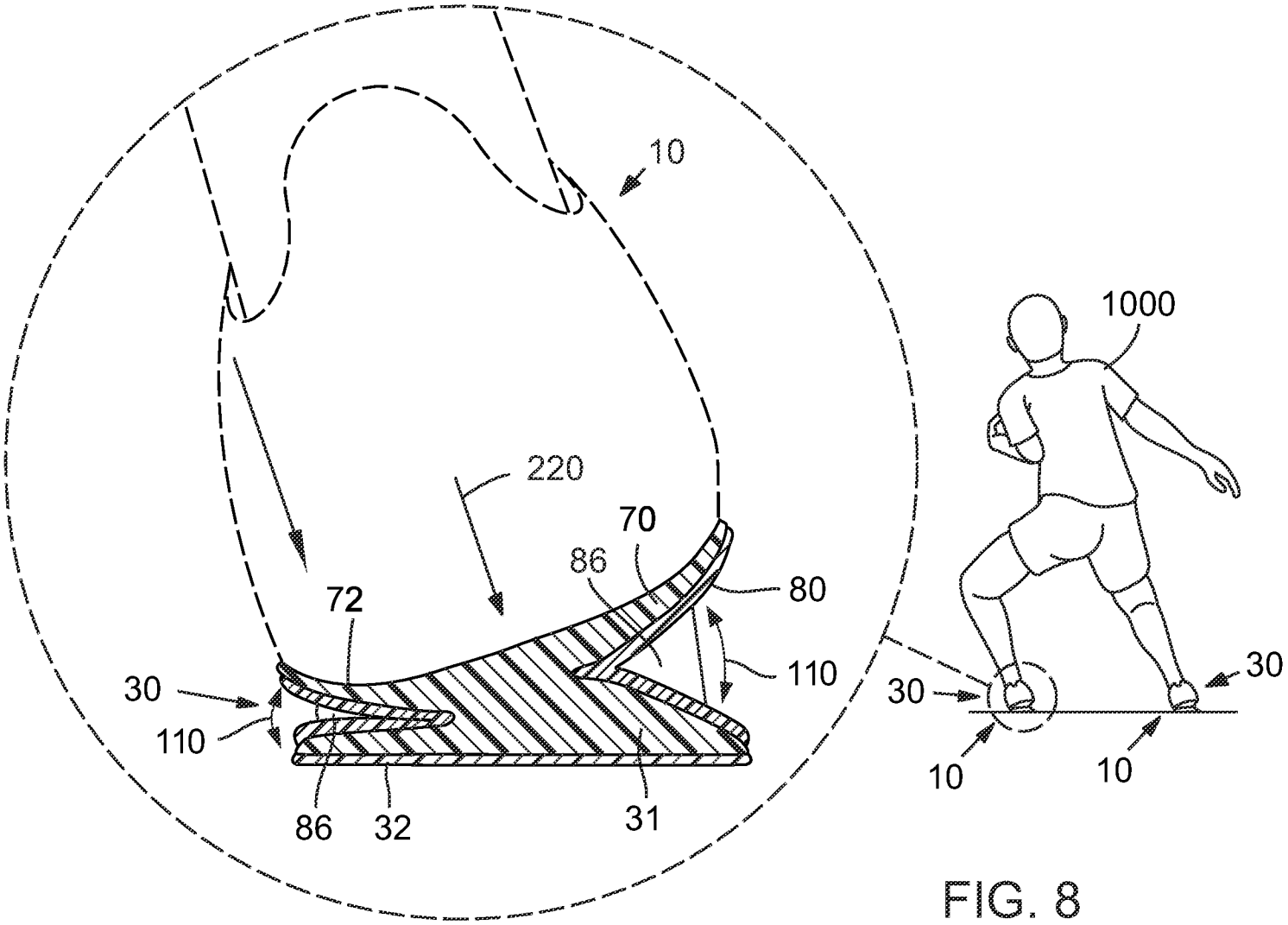
FIGS. 8-9 are cross-sectional views of articles of footwear having midsoles and elongate inserts, showing possible application of lateral or banking forces.
Figure 9:
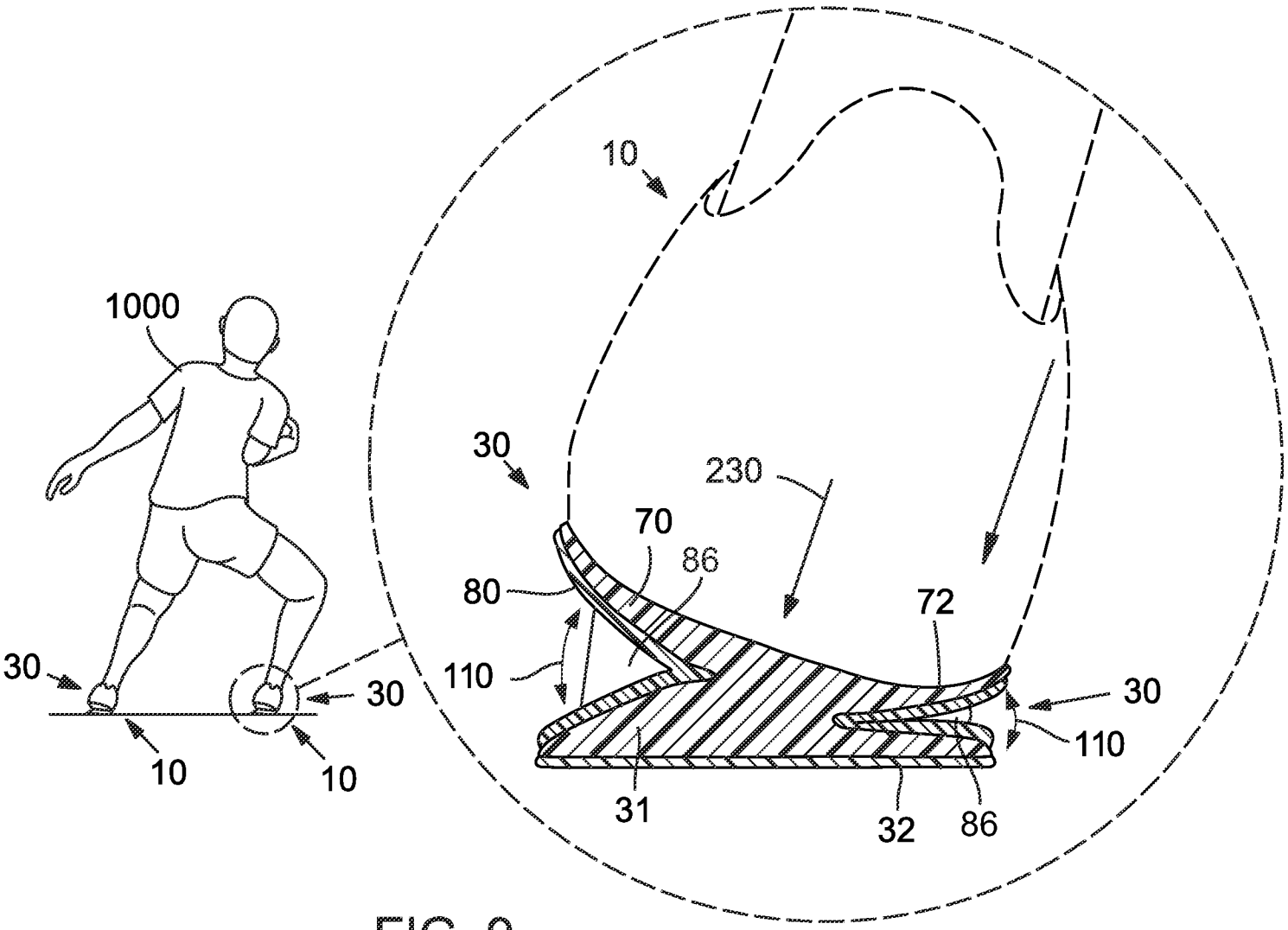

FIGS. 7-9 depict the response of spring 100 and footwear 10 to the application of various forces. For example, as depicted in FIG. 7, footwear 10 is acted upon by a primarily downward or vertical force being applied by a wearer 1000 in the direction of arrow 210, such as a force associated with standing, walking, or running. The substantially even distribution of the downward vertical force allows midsole 31 and insert 80 to cushion and support the medial and lateral sides equally.

In contrast, with reference to FIG. 8, footwear 10 is acted upon by a left-side banking force in the direction of arrow 220 being applied by wearer 1000. The left-side banking force applied to footwear 10 causes the left side of spring 100 to deflect downward while the right side of spring 100 deflects upward. As a result, the amount of cushioning offered in the direction of the left-side banking force is reduced while the support for the wearer's foot increases.

Similarly, FIG. 9 depicts footwear 10 as being acted upon by a right-side banking force in the direction of arrow 230 by wearer 1000. The right-side banking force applied to footwear 10 causes the right side of spring 100 to deflect downward while the left side of spring 100 deflects upward. As a result, the amount of cushioning offered in the direction of the right-side banking force is reduced while the support for the wearer's foot increases.

In FIGS. 8 and 9, the amount of cushioning in the direction of the applied force may be reduced while the support provided to the wearer's foot increase. This improves the wearer's "feel" of the ground when banking laterally, and the reduced cushioning tends to improve the response time of the footwear thereby making the wearer's lateral banking time quicker. The shape of elongate groove 60 of midsole 31 may be optimized to provide a desired level of cushioning. Similarly, the material and thickness of elongate insert 80 may allow the support and cushioning of sole structure 30 to be optimized for a particular activity, or type of athlete.

While spring 100 is depicted as resisting vertical forces equally on medial side 15 and lateral side 14 of footwear 10, in other configurations, spring 100 may resist vertical forces to a greater degree on medial side 15 than on lateral side 14, or may resist vertical forces to a greater degree on lateral side 14 than on medial side 15. That is, a portion of elongate insert 80 adjacent to medial portion 54 of outer edge 50 may have a first stiffness, and a portion of elongate insert 80 adjacent to lateral portion 56 of outer edge 50 may have a second stiffness, and the first stiffness may be less than, substantially equal to, or greater than the second stiffness.

Further Configurations

Figure 10:
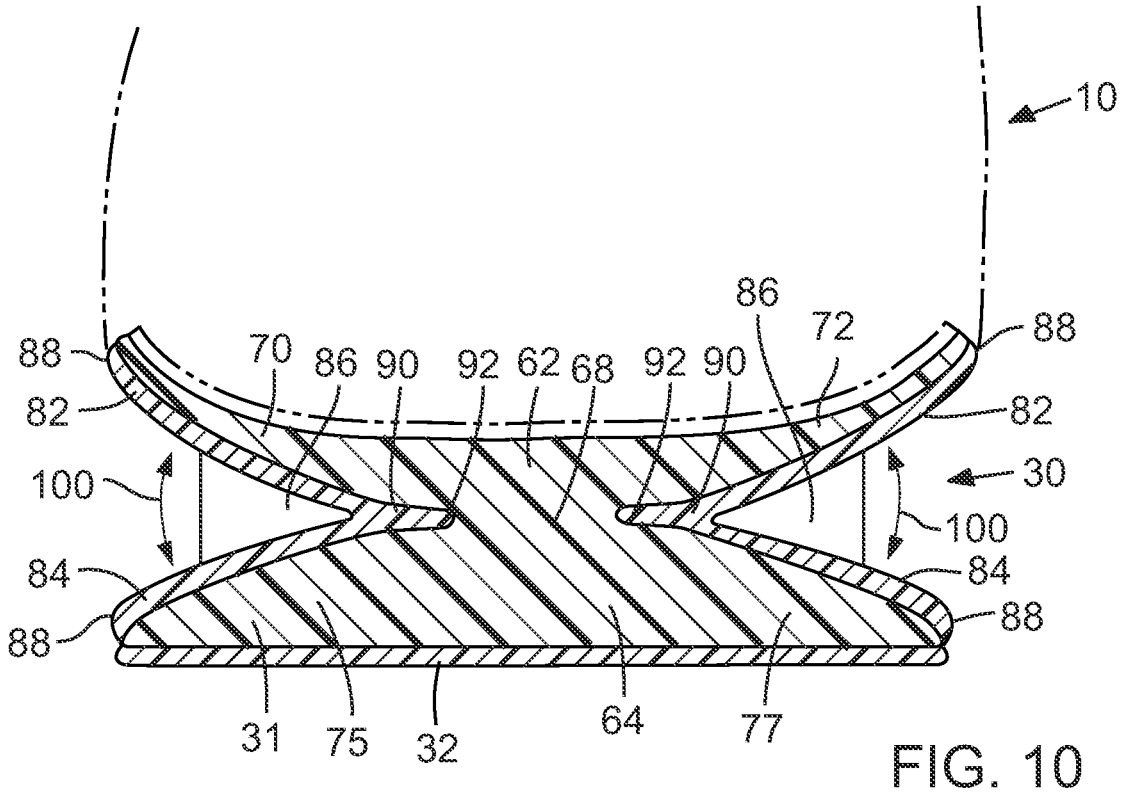
FIGS. 10-12 are cross-sectional views depicting further articles of footwear having midsoles and elongate inserts.
Figure 11:
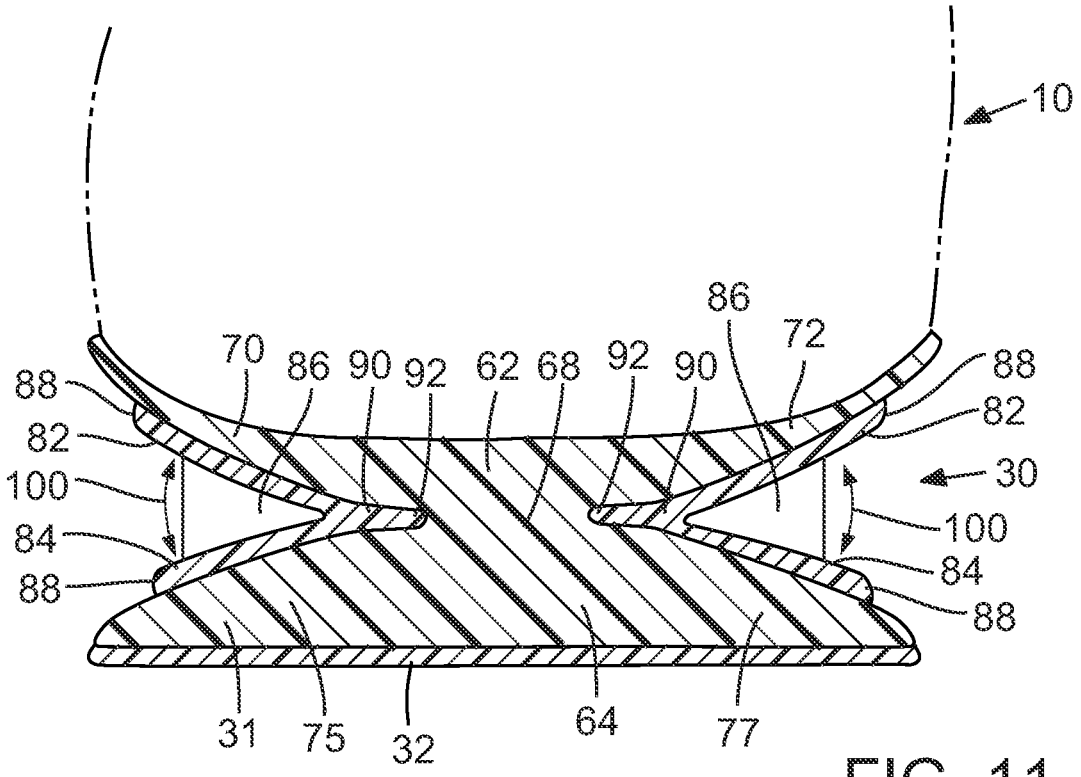

In FIGS. 1-6, upper flange 82 and lower flange 84 are depicted as having outer edges 88 that extend toward, but do not reach, peripheral edges of upper portion 62 and lower portion 64 of midsole 31. Elongate groove 60 accordingly covers the inner surface of insert 80. In other configurations of footwear 10, the outward extent of outer edges 88 relative to peripheral edges of midsole 31 may differ. For example, as depicted in FIG. 10, outer edges 88 extend beyond peripheral edges of portions 62 and 64 to cover portions 62 and 64. In contrast, as depicted in FIG. 11, the outward extent of outer edges 88 relative to peripheral edges of midsole 31 is less than depicted in FIGS. 1-6, and a greater extent of portions 62 and 68 are accordingly exposed.

Figure 12:
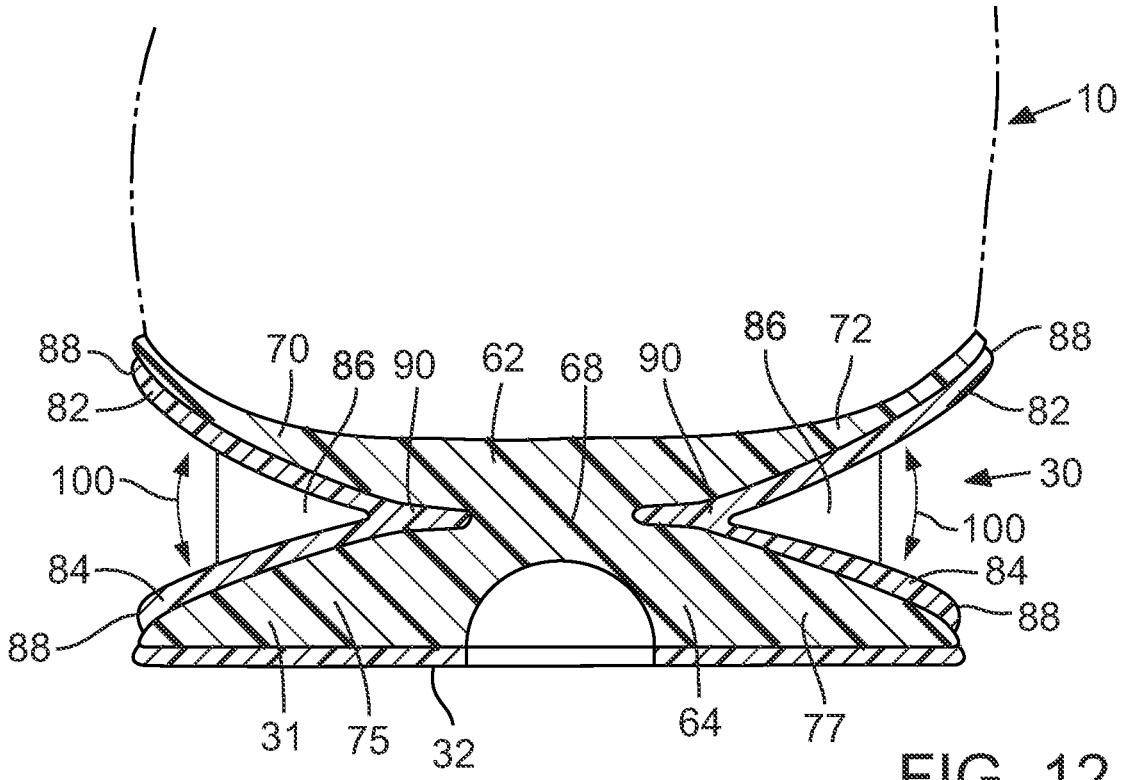

As depicted in FIGS. 1-6, midsole 31 has a largely planar upper surface secured to upper 20 and a largely planar lower surface secured to outsole 32. In alternate configurations such as the configuration depicted in FIG. 12, an arcuate recess may extend into lower portion 62 of midsole 31, and an aperture extending through outsole 32 may expose the arcuate recess.

Figure 13:
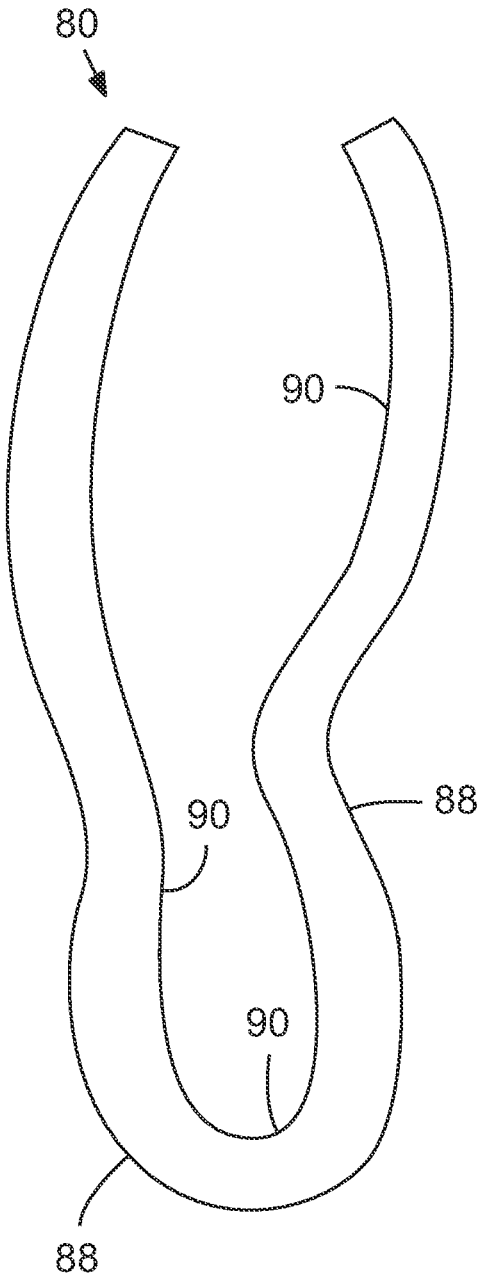
FIGS. 13-16 are top plan views corresponding with FIG. 5 and depicting further configurations of the elongate insert.

FIGS. 1-6 depict horizontal flange 92 of insert 80 as including comb-like region 94. However, in, some configurations of footwear 10, comb-like region 94 may be absent, and horizontal flange 92 of insert 80 may be smooth in forefoot region 11, as depicted in the exemplary configuration in FIG. 13.

Figure 14:
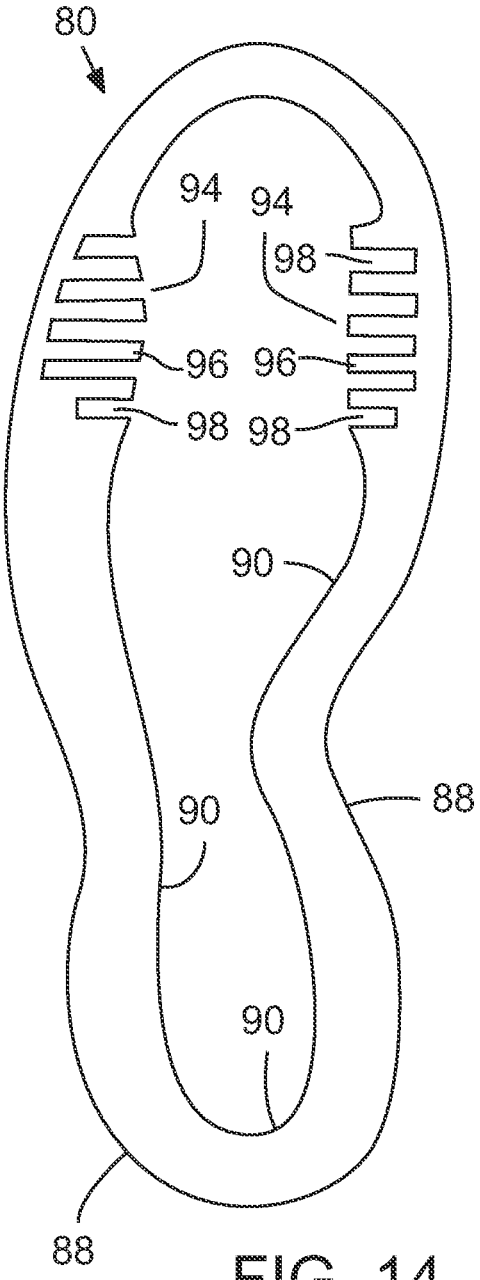
Figure 16:
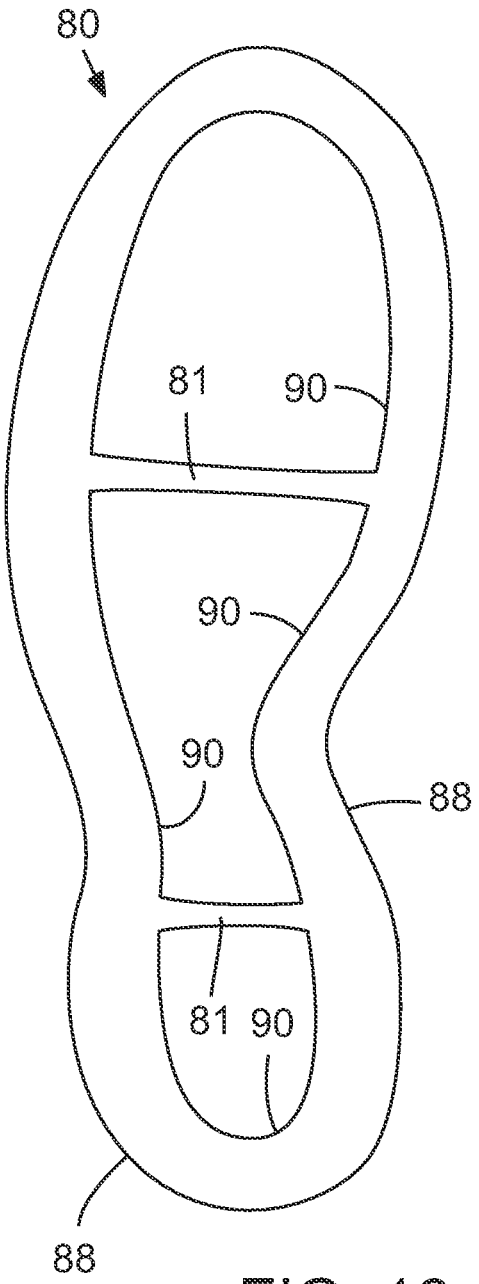

Moreover, while FIGS. 1-6 depict insert 80 as extending around medial portion 54, heel portion 58, and lateral portion 56, but being substantially absent from forefoot region 11 of footwear 10, insert 80 may additionally extend around forefoot portion 52 as depicted in FIG. 14. In some such configurations, bridging members 81 may extend between medial portion 54 and lateral portion 56 of insert 80, as depicted in FIG. 16. More generally, bridging members 81 may extend through midsole 31 and between various portions of insert 80.

Figure 15:
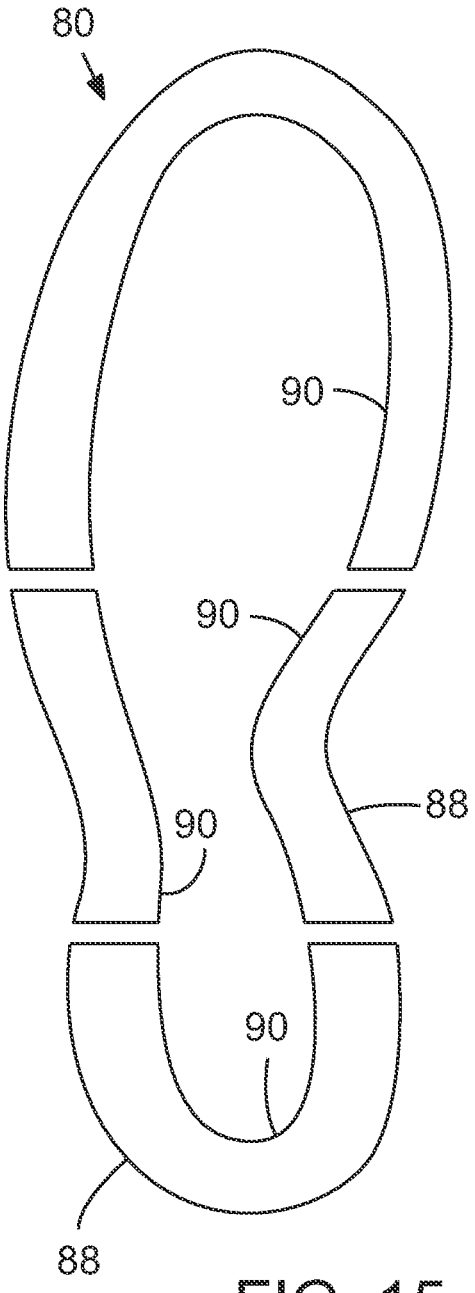

FIGS. 1-6 depict insert 80 as being a continuous structure. Other configurations of insert 80 are also possible. For example, as FIG. 15 depicts, insert 80 may be discontinuous, and may be secured as separate pieces to forefoot portion 52, medial portion 54, heel portion 58, and lateral portion 56 of outer edge 50.

Figure 17:
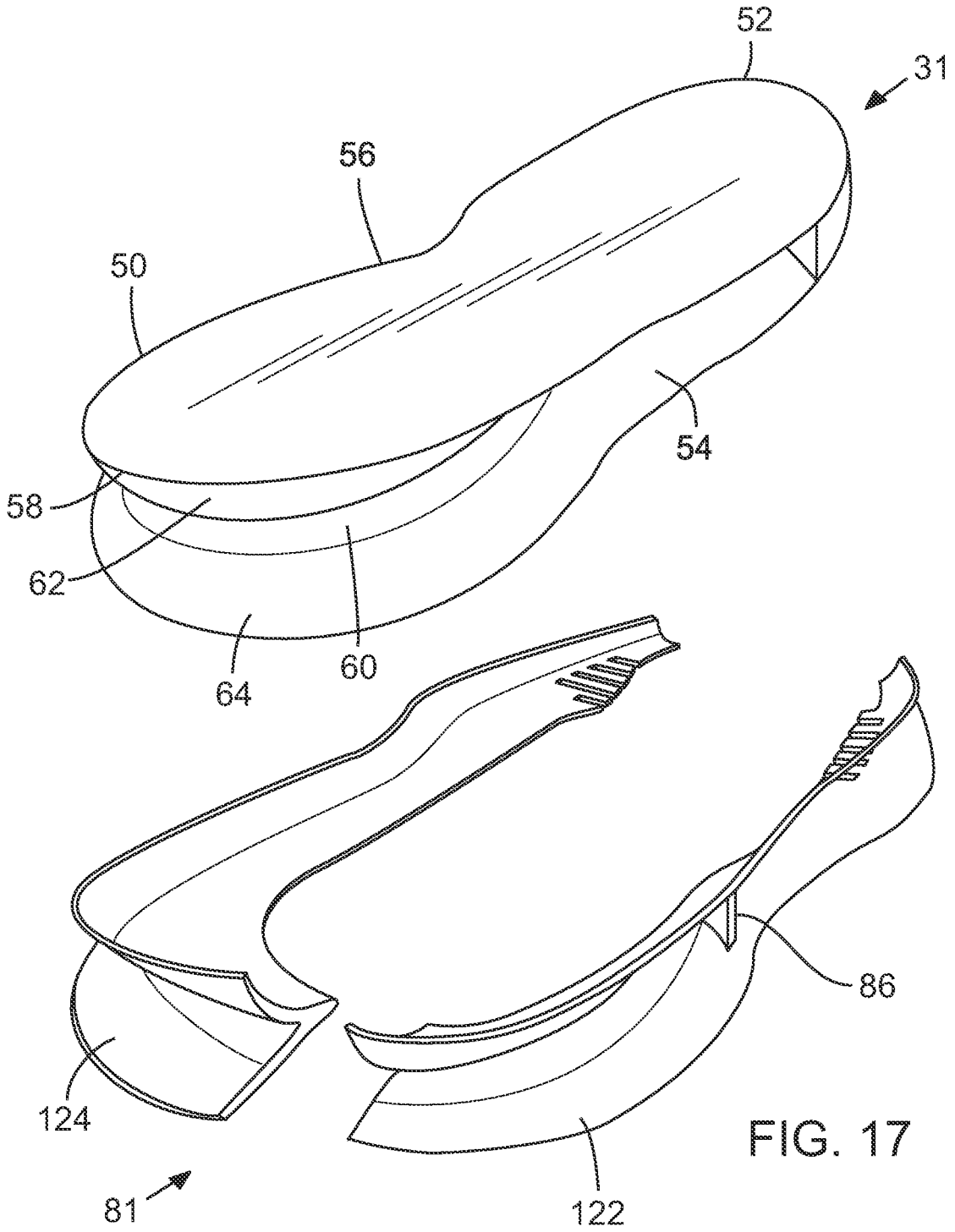
FIG. 17 is a perspective view corresponding with FIG. 6 and depicting an alternate configuration of the elongate insert.

In another exemplary embodiment depicted in FIG. 17, insert 80 may include a medial section 122 and a lateral section 124. Sections 122 and 124 may be inserted into elongate groove 60 at medial portion 54 and lateral portion 56, and may optionally be bonded together to form a seam at heel portion 58.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A sole structure for an article of footwear, the sole structure comprising:

a midsole including an outer peripheral surface that tapers in a direction toward a ground-contacting surface of the sole structure and extends from a medial side of the sole structure to a lateral side of the sole structure;

an insert having a first flange attached to the outer peripheral surface and a second flange attached to the first flange at a joined region and opposing the first flange to define a recess between a first flange surface of the first flange and a second flange surface of the second flange, the first flange and the second flange extending from the medial side of the sole structure to the lateral side of the sole structure; and a stability fin disposed within the recess adjacent to the joined region of the insert and defining (a) a thickness measured along a first direction parallel to the first flange surface and the second flange surface and (b) a height measured along a second direction transverse to the first flange surface and the second flange surface, the height of the stability fin being greater than the thickness of the stability fin.

2. The sole structure of claim 1, wherein the first flange is joined to the second flange to provide the insert with a substantially V-shape in cross-section.

3. The sole structure of claim 1, wherein the outer peripheral surface extends from the medial side of the sole structure to the lateral side of the sole structure along a heel region of the sole structure.

4. The sole structure of claim 3, wherein the insert extends from the medial side of the sole structure to the lateral side of the sole structure along the heel region.

5. The sole structure of claim 1, wherein the first flange is attached to the outer peripheral surface from an outer edge of the first flange to the joined region.

6. The sole structure of claim 1, wherein the second flange is disposed closer to the ground-contacting surface of the sole structure than the first flange.

7. The sole structure of claim 1, wherein the midsole is formed from a different material than the insert.

8. The sole structure of claim 1, wherein the insert has a higher rigidity than the midsole.

9. The sole structure of claim 1, wherein the first flange surface and the second flange surface extend continuously from the medial side of the sole structure to the lateral side of the sole structure.

10. An article of footwear incorporating the sole structure of claim 1.

11. A sole structure for an article of footwear, the sole structure comprising:

a midsole including an outer peripheral surface that tapers in a direction toward a ground-contacting surface of the sole structure and extends from a medial side of the sole structure to a lateral side of the sole structure;

an insert having a first flange extending along the outer peripheral surface from a first outer edge to a joined region and a second flange attached to the first flange at the joined region and extending to a second outer edge to provide the insert with a substantially V-shape in cross-section, the first flange and the second flange extending from the medial side of the sole structure to the lateral side of the sole structure; and a stability fin including (a) a first edge defining a height of the stability fin extending from a first flange surface between the first outer edge and the joined region to a second flange surface between the second outer edge and the joined region and (b) a pair of side surfaces each extending (i) transverse to the first flange surface and the second flange surface and (ii) from the first edge towards the joined region, a distance between the side surfaces defining a thickness of the stability fin that is less than the height of the stability fin.

12. The sole structure of claim 11, wherein the first flange surface opposes the second flange surface.

13. The sole structure of claim 11, wherein the outer peripheral surface extends from the medial side of the sole structure to the lateral side of the sole structure along a heel region of the sole structure.

14. The sole structure of claim 13, wherein the insert extends from the medial side of the sole structure to the lateral side of the sole structure along the heel region.

15. The sole structure of claim 11, wherein the first flange is attached to the outer peripheral surface from an outer edge of the first flange to the joined region.

16. The sole structure of claim 11, wherein the second flange is disposed closer to a ground-contacting surface of the sole structure than the first flange.

17. The sole structure of claim 11, wherein the midsole is formed from a different material than the insert.

18. The sole structure of claim 11, wherein the insert has a higher rigidity than the midsole.

19. The sole structure of claim 11, wherein the first flange surface and the second flange surface extend continuously from the medial side of the sole structure to the lateral side of the sole structure.

20. An article of footwear incorporating the sole structure of claim 11.

* * * * *